US007339166B2

(12) United States Patent
Tang et al.

(10) Patent No.: US 7,339,166 B2
(45) Date of Patent: Mar. 4, 2008

(54) INTERFACE AND PROCESS FOR ENHANCED TRANSMISSION OF NON-CIRCULAR ION BEAMS BETWEEN STAGES AT UNEQUAL PRESSURE

(75) Inventors: Keqi Tang, Richland, WA (US); Alexandre A. Shvartsburg, Richland, WA (US); Richard D. Smith, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 191 days.

(21) Appl. No.: 11/361,264

(22) Filed: Feb. 24, 2006

(65) Prior Publication Data

US 2007/0200059 A1 Aug. 30, 2007

(51) Int. Cl.
*H01J 49/06* (2006.01)

(52) U.S. Cl. ..... 250/288; 250/396 R; 250/423 R; 250/281; 250/282

(58) Field of Classification Search ..... None
See application file for complete search history.

(56) References Cited

U.S. PATENT DOCUMENTS

| | | | | |
|---|---|---|---|---|
| 5,420,424 | A | 5/1995 | Carnahan et al. | |
| 6,107,628 | A | 8/2000 | Smith et al. | |
| 6,512,224 | B1 | 1/2003 | Miller et al. | |
| 6,583,408 | B2 * | 6/2003 | Smith et al. | 250/288 |
| 6,815,669 | B1 | 11/2004 | Miller et al. | |
| 6,818,890 | B1 | 11/2004 | Smith et al. | |
| 6,967,325 | B2 | 11/2005 | Smith et al. | |
| 7,256,395 | B2 * | 8/2007 | Collings et al. | 250/288 |
| 7,259,371 | B2 * | 8/2007 | Collings et al. | 250/288 |
| 2005/0151072 | A1 | 7/2005 | Guevremont et al. | |

FOREIGN PATENT DOCUMENTS

| | | |
|---|---|---|
| WO | WO 00/08455 | 2/2000 |
| WO | WO 03/067236 A2 | 8/2003 |
| WO | WO 03/067236 A3 | 8/2003 |
| WO | WO 03/067243 A1 | 8/2003 |

OTHER PUBLICATIONS

Shvartsburg et al., J.Am. Soc. Mass Spectrom. 2004, vol. 16, pp. 2-13.
Krylov, et al., International Journal of Mass Spec., 225, 2003, pp. 39-51.
Tang, et al., Anal. Chem, 2005, 77, pp. 3330-3339 pp. 2-13.

* cited by examiner

*Primary Examiner*—Nikita Wells
(74) *Attorney, Agent, or Firm*—James D. Matheson

(57) ABSTRACT

The invention discloses a new interface with non-circular conductance limit aperture(s) useful for effective transmission of non-circular ion beams between stages with different gas pressure. In particular, the invention provides an improved coupling of field asymmetric waveform ion mobility spectrometry (FAIMS) analyzers of planar or side-to-side geometry to downstream stages such as mass spectrometry or ion mobility spectrometry. In this case, the non-circular aperture is rectangular; other geometries may be optimum in other applications. In the preferred embodiment, the non-circular aperture interface is followed by an electrodynamic ion funnel that may focus wide ion beams of any shape into tight circular beams with virtually no losses. The jet disrupter element of the funnel may also have a non-circular geometry, matching the shape of arriving ion beam. The improved sensitivity of planar FAIMS/MS has been demonstrated in experiments using a non-contiguous elongated aperture but other embodiments (e.g., with a contiguous slit aperture) may be preferable, especially in conjunction with an ion funnel operated at high pressures.

43 Claims, 6 Drawing Sheets

INTERFACE AND PROCESS FOR ENHANCED TRANSMISSION OF NON-CIRCULAR ION BEAMS BETWEEN STAGES AT UNEQUAL PRESSURE

This invention was made with Government support under Contract DE-AC05-76RLO1830 awarded by the U.S. Department of Energy. The Government has certain rights in the invention.

FIELD OF THE INVENTION

The present invention relates generally to instrumentation and methods for guidance and focusing of ions in the gas phase. More particularly, the invention relates to interfaces for ion transmission between coupled stages for analysis, characterization, separation, and/or generation of ions at different gas pressures.

BACKGROUND OF THE INVENTION

Field asymmetric waveform ion mobility spectrometry (FAIMS) is gaining broad acceptance as a post-ionization separation method coupled to mass spectrometry (MS), e.g., as reviewed by Guevremont (*J. Chromatogr. A* 2004, 1058, 3). Unlike conventional ion mobility spectrometry (IMS) based on the absolute ion mobilities (K), FAIMS separates ions by the difference between K in a particular gas at high and low electric fields (E). In practice, this takes place in the gap between a pair of electrodes carrying an asymmetric high-voltage waveform (the analytical gap). Ions are typically moved through the gap by gas flow. Alternatively, in the longitudinal field-driven FAIMS described by Miller et al. (U.S. Pat. No. 6,512,224, U.S. Pat. No. 6,815,669), ions are moved by a weak electric field along the gap, created by segmented FAIMS electrodes or separate electrodes in addition to FAIMS electrodes. The asymmetric waveform (with peak amplitude known as dispersion voltage, DV) comprises a dc offset known as the compensation voltage (CV). At any CV value, only a small subset of ions with similar forms of K(E) may pass FAIMS, while other ions entering the gap become unbalanced and are eliminated by neutralization on either electrode. Thus the spectrum of an ionic mixture may be revealed by scanning or stepping CV over a relevant range. Application methods exploiting FAIMS have emerged in diverse areas, including proteomics, metabolomics, environmental and industrial quality control, natural resource management, and homeland security. To increase the separation peak capacity and specificity, FAIMS is typically coupled to other analytical stages downstream—MS and, more recently, conventional IMS and IMS/MS, e.g., as discussed by Tang et al. (*Anal. Chem.* 2005, 77, 6381).

The analytical gap of FAIMS devices may have a planar (p-) or curved (c-) geometry (in practice, a cylindrical, a spherical, or a sequential combination of cylindrical and spherical elements). The electric field is spatially homogeneous in planar but not in curved gaps. A time-dependent inhomogeneous field in a gap focuses ions to the gap median (or defocuses them away from the median), e.g., as discussed by Guevremont and Purves (*Rev. Sci. Instrum.* 1999, 70, 1370). The ion focusing in c-FAIMS and its absence in p-FAIMS have profound consequences for merits of those configurations, as described below.

A p-FAIMS has four intrinsic advantages over any c-FAIMS. In (1), ion focusing broadens the CV range of ions that achieve equilibrium within the gap and thus pass FAIMS regardless of the residence time. Hence p-FAIMS has a narrower CV pass band than a c-FAIMS, meaning an improved resolution, peak capacity, and specificity that allow one to separate (identify) species that cannot be distinguished or assigned using c-FAIMS. In (2), according to theoretical modeling of the present inventors, the resolution improvement is retained even at constant ion transmission efficiency, i.e., p-FAIMS provides not merely a higher resolution than c-FAIMS, but also a superior resolution/sensitivity balance (i.e., a higher resolution at equal sensitivity or higher sensitivity at equal resolution). In (3), ion focusing in c-FAIMS is not uniform: some ions (in general those with steep K(E) and thus high absolute CV) are confined more effectively than others, e.g., as discussed by Krylov (*Int. J. Mass Spectrom.* 2003, 225, 39). This greatly distorts the relative abundances of different ions in a mixture, which complicates quantification. In extreme cases, some ions (typically those with a virtually flat K(E) and thus near-zero CV) may be focused only marginally if at all, precluding their observation altogether. Absence of ion focusing in p-FAIMS means analyses without discrimination, with measured abundances closely reflecting the composition of sampled ion mixture. In (4), a c-FAIMS cannot process all ions simultaneously because the waveform of either polarity focuses some species but defocuses and eliminates others from the gap. For example, ions with positive K(E) slope (termed A-type) require one polarity (e.g., modes P1 or N1), while those with negative K(E) slope (C-type) require the opposite polarity (e.g., modes P2 or N2). The ion type depends on the carrier gas identity, temperature, and pressure: an ion may fall under different types under different conditions. In general, the ion type cannot be deduced a priori, and mixtures may comprise ions of more than one type. So analyses using c-FAIMS must often be repeated in both modes, reducing the duty cycle with a proportional impact on sensitivity. Planar FAIMS analyzes all ions in a single mode, with a significantly higher duty cycle.

The other two advantages of p-FAIMS are of a mechanical rather than a fundamental nature. In (5), unlike for c-FAIMS, the width of a planar gap may be adjusted easily and rapidly (e.g., for resolution control as reported by Shvartsburg et al., *J. Am. Soc. Mass Spectrom.* 2005, 16, 2). In (6), p-FAIMS allows a simpler, more compact design than curved geometries, which reduces the overall instrument size, weight, cost, and electrical power consumption.

Despite many benefits of p-FAIMS summarized above, practical FAIMS/MS systems have mostly adopted curved geometries: the cylindrical (taught, e.g., by Carnahan and Tarassov in U.S. Pat. No. 5,420,424) or "dome" (a cylinder with hemispherical terminus, taught, e.g., by Guevremont and Purves in WO 00/08455). That was mainly for the lack of effective MS interfaces for p-FAIMS. Ions in a planar gap are free to diffuse parallel to the electrodes (transversely to the gas flow), creating ribbon-shaped ion beams at the FAIMS exit. However, all inlets known in the art of MS and IMS have circular orifices. In systems involving atmospheric-pressure ionization (API) sources such as electrospray ionization (ESI) or atmospheric-pressure matrix assisted laser desorption ionization (AP-MALDI), the vacuum constraints of a $1^{st}$ MS stage restrict the diameters of conductance limit apertures. Typical values (for either "heated capillary" or "curtain gas" interfaces) are ~0.2-0.5 mm, as shown in FIG. 1. In comparison, a planar FAIMS gap normally spans ~10-20 mm at least, producing ion beams with span of ~5-10 mm and greater. Therefore, coupling p-FAIMS to standard MS (or low-pressure IMS) inlets results in huge ion losses. In contrast, a "dome" FAIMS could be readily interfaced to circular MS inlets with minimum ion losses.

In some FAIMS/MS systems, a cylindrical FAIMS is configured in a "side-to-side" ("perpendicular-gas-flow") arrangement, as described, e.g., by Guevremont et al. (WO 01/69216), rather than in axial or dome geometry. Further variations of "side-to-side" FAIMS are described, e.g., by Guevremont et al.: a segmented device (WO 03/067236; US Pat. App. #20050151072) and an analyzer with a non-uniform gap width (WO 03/067243). In "side-to-side" FAIMS, the gas flow carries ions through the annular gap between two cylinders with coincident or parallel axes transversely, with ions exiting through a round hole on the opposite side of external cylinder. While ions in "side-to-side" FAIMS are focused to the gap median as in any c-FAIMS, they are free to diffuse parallel to electrode axis, also forming a ribbon-shaped beam in the FAIMS gap away from the injection point. This could result in significant ion losses when ions are extracted through a round exit orifice.

The above discussion with respect to planar vs. curved FAIMS geometries equally applies to higher-order differential ion mobility separation (HODIMS) analyzers as described, e.g., by Shvartsburg et al. (U.S. patent application, Ser. No. 11/237,523). In HODIMS, ions are separated based on the $2^{nd}$ or higher K(E) derivatives (as opposed to the $1^{st}$ derivative in FAIMS) using different asymmetric waveforms. Though HODIMS is not at all a part of FAIMS art, HODIMS analyzers may mechanically resemble those employed for FAIMS, with planar and "side-to-side" geometries equally possible for HODIMS. Hence the issues involved in coupling planar or "side-to-side" HODIMS devices to downstream stages would mirror those arising for FAIMS. Accordingly, any mention of FAIMS below will be understood to also cover HODIMS.

Ion mobility spectrometry with alignment of dipole direction (IMS-ADD) described by Shvartsburg et al. (US patent application Ser. No. 11/097,855) is a technology for separation and characterization of ions based largely on direction-specific ion-molecule cross sections, as opposed to orientationally-averaged cross-sections in conventional IMS. Though IMS-ADD is by no means a part of FAIMS art, IMS-ADD analyzers may mechanically resemble those employed for FAIMS and particularly for longitudinal field-driven FAIMS in a planar geometry. Hence the issues involved in coupling IMS-ADD devices to downstream stages would mirror those arising for p-FAIMS. Accordingly, any mention of FAIMS below will be understood to also cover IMS-ADD.

Fully exploiting the advantages of p-FAIMS or "side-to-side" FAIMS in FAIMS/MS, FAIMS/IMS, or FAIMS/IMS/MS systems is predicated on a practical interface between those FAIMS arrangements and the following stage. Accordingly, there is a need for new interfaces that could effectively capture ribbon-like ion beams and transmit them to downstream stages such as MS or IMS. The same challenge will arise whenever a rectangular or other non-circular ion beam is transmitted to MS, IMS, or another stage operating at a different (typically, but not necessarily lower) pressure. For example, such a non-circular beam may be generated by an ESI or AP-MALDI ion source comprising several emitters disposed along a line or in another non-circular arrangement.

SUMMARY OF THE INVENTION

The invention discloses an interface for improved transmission of non-circular ion beams between two coupled instrument stages for analysis, characterization, separation, and/or generation of gas-phase ions with different gas pressures therein. This objective is achieved by providing a non-circular conductance limit aperture having the highest possible overlap with the cross-section of ion beam to be transmitted, within the constraint of maximum aperture area allowing one to maintain the desired pressure differential between the stages. The non-circular aperture may be either contiguous (connecting without a break) or non-contiguous (consisting of several contiguous elementary openings).

In one aspect, the invention is intended for (but not limited to) interfacing planar or "side-to-side" FAIMS to MS, IMS, and like downstream stages. In that application, the non-circular aperture would have a rectangular or other elongated geometry designed for the highest possible overlap with the cross-section of a ribbon-shaped ion beam emerging from those FAIMS arrangements. In "side-to-side" FAIMS, the exit orifice will also need to be changed to an elongated geometry.

Non-circular ion beams collected by a non-circular aperture of the present invention usually need focusing into tight circular beams prior to injection into the following MS stages such as quadrupoles or other multipoles, quadrupole ion traps, ion cyclotron resonance (ICR) or Fourier-Transform ICR cells, or into IMS, selected-ion flow tube (SIFT), or other drift tubes. Hence, in another aspect, this invention provides for an electrodynamic ion funnel with sufficient entrance orifice installed behind a non-circular aperture. When an incoming ion beam fits fully within that orifice and the pressure is in the proper operating range, ions will be focused virtually without losses into a circular beam with the diameter determined by the funnel exit aperture.

The performance of ion funnels is normally enhanced (in particular, chemical noise is reduced) by a jet disrupter element installed in the funnel. Along with desolvated analyte ions, gas jets coming from API inlets carry incompletely desolvated microdroplets, solvent/matrix clusters, and other (near)-neutral contaminants. A disrupter in the jet path removes those species, while ions in the m/z range of analytical interest are deflected away by surrounding electric fields and then focused by the funnel. Jet disrupter embodiments known in the art are round, as appropriate for round gas jets coming from circular inlets. Non-circular inlets would produce non-circular jets for which a round jet disrupter may be less effective. Hence, in another aspect, the present invention provides for a non-circular jet disrupter with the geometry maximizing the overlap with a non-circular gas jet. In particular, for interfacing of planar and "side-to-side" FAIMS or other applications involving elongated apertures, the jet disrupter would also have an elongated shape.

DETAILED DESCRIPTION

The present invention discloses an interface and process for transmission of ions in other than circular beams between coupled instrument stages at different gas pressures. While the present disclosure is exemplified by specific embodiments, it should be understood that the invention is not limited thereto, and variations in form and detail may be made without departing from the spirit and scope of the invention. All such modifications as would be envisioned by those of skill in the art are hereby incorporated.

A non-circular aperture will now be described with reference to FIGS. 2*a*-2*f* and FIGS. 3*a*-3*c*.

Figure 2A:
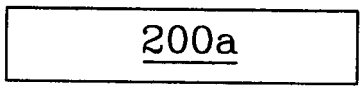
FIGS. 2*a*-2*f* illustrate contiguous non-circular apertures, according to various embodiments of the invention.
Figure 2B:
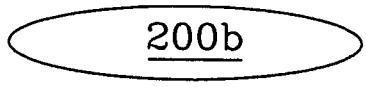
Figure 2C:
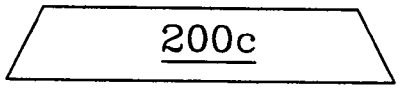
Figure 2D:
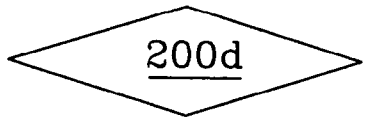
Figure 2E:
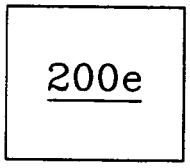
Figure 2F:
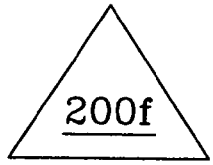

FIGS. 2*a*-2*f* illustrate contiguous non-circular apertures 200*a*-200*f*, according to different embodiments of the invention. For example, an interface with the conductance limit aperture having the geometry of a rectangle (slit) 200*a*, an ellipsoid (ovoid) 200*b*, a trapezoid 200*c*, or a rhombus 200*d* provides a more efficient coupling of planar or "side-to-side" FAIMS to downstream stages including, but not limited to, MS, IMS, FAIMS, IMS-ADD, or HODIMS. The elongated shape of apertures 200*a*-200*d* allows them to cover a greater fraction of the rectangular cross-section of analytical gap of p-FAIMS or of an elongated exit orifice of "side-to-side" FAIMS than a circular aperture of equal area, with an approximately proportional increase of ion transmission through the interface and thus of the overall instrumental sensitivity. As illustrated in the figures, the specific contiguous geometry may vary, with shapes including, but not limited to, rectangular (FIG. 2*a*), ellipsoid or ovoid (FIG. 2*b*), trapezoidal (FIG. 2*c*), or rhombic (FIG. 2*d*). In other applications, a non-circular aperture may have not elongated geometries, e.g., square (FIG. 2*e*), triangular (FIG. 2*f*), or another depending on the ion beam shape.

Figure 3A:
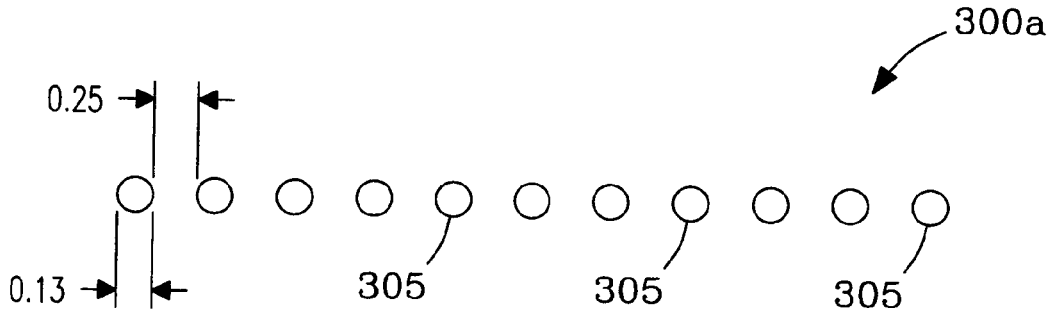
FIGS. 3*a*-3*c* illustrate non-contiguous non-circular apertures, according to various alternative embodiments of the invention.
Figure 3B:
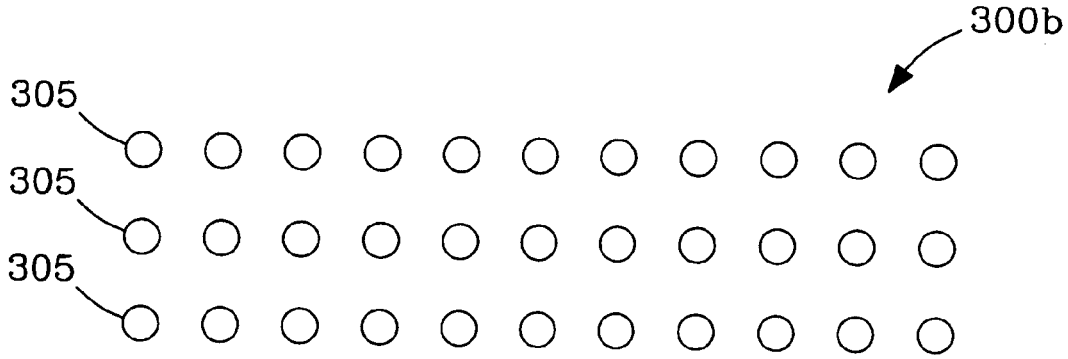
Figure 3C:
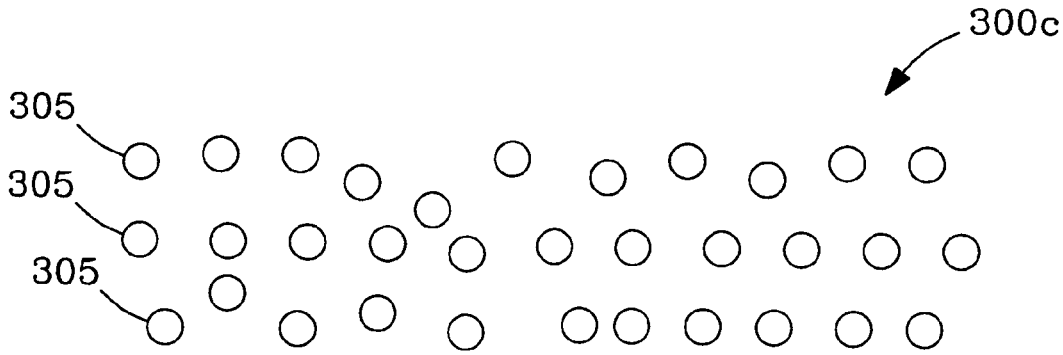

FIGS. 3*a*-3*c* illustrate non-contiguous non-circular apertures 300*a*-300*c* comprising a number of elementary openings 305 of circular, square, or other shape. Openings are disposed along one straight line (FIG. 3*a*), multiple straight lines (FIG. 3*b*), or in another arrangement (FIG. 3*c*). The apertures in FIGS. 3*a*-3*c* have an elongated overall form that is suitable, in particular, for coupling planar or "side-to-side" FAIMS to various downstream stages, as described above. In other applications, a non-contiguous aperture may comprise openings covering a square, triangular, or other form.

With respect to coupling of p-FAIMS, effectively the maximum possible ion transmission may be achieved using an elongated aperture with one or both dimensions substantially smaller than the analytical gap opening. This is because waveform-induced oscillations, diffusion, and mutual Coulomb repulsion continuously remove ions near FAIMS electrodes, and ions concentrate around the gap median. The actual width of exiting ion beam depends on FAIMS parameters, such as the waveform frequency, voltage, and profile. For example, a higher voltage and/or lower frequency increase the ion oscillation amplitude and thus narrow the beam. The mobility of a particular ion also matters: higher mobility leads to larger oscillations and thus to narrower beams. Simulations for a common 2-mm gap show a typical beam width of ~0.3-0.7 mm. The aperture could have the same width, or be somewhat narrower as the gas dynamics near an aperture followed by a pressure drop guides ions inside the aperture. The span of ion beam along the gap is determined by ion residence time in FAIMS and the ion diffusion coefficient, and hence also differs from ion to ion. By simulations, the effective beam span is often significantly less than the gap span. Again, an aperture span somewhat smaller than the beam span will be effective because of gas dynamics. Of course, vacuum constraints of one of the stages coupled by an aperture may necessitate reducing aperture dimension(s) below those providing maximum ion transmission efficiency.

Figure 4A:
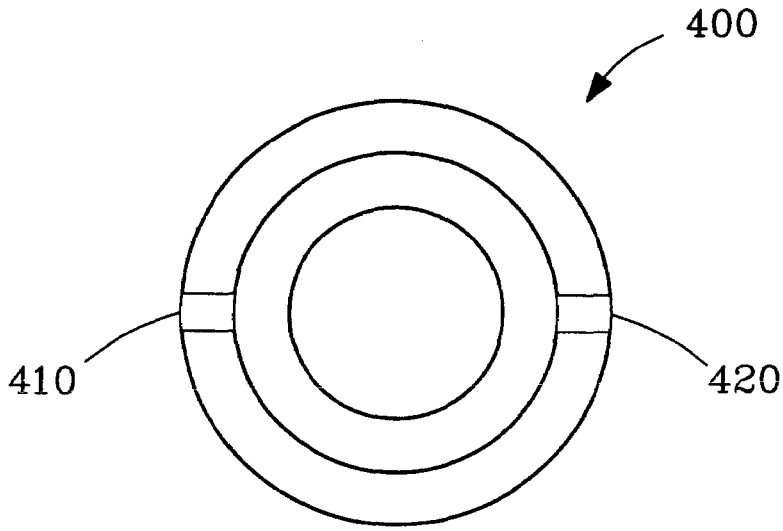
FIG. 4*a* illustrates a (vertical) cross-sectional view of a "side-to-side" FAIMS with an entrance orifice and an elongated exit orifice, according to an embodiment of the invention.
Figure 4B:
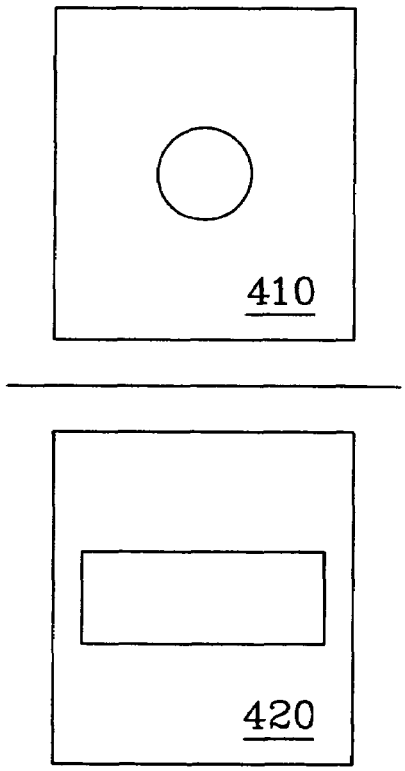
FIG. 4*b* illustrates the entrance and exit orifices of a "side-to-side" FAIMS of FIG. 4*a* (the front and back view, respectively), according to an embodiment of the invention.

With respect to coupling of "side-to-side" FAIMS, we refer to FIG. 4*a* illustrating its cross-sectional side view 400, a round entrance orifice 410, and an elongated (rectangular) exit orifice 420, according to an embodiment of the invention. FIG. 4*b* illustrates corresponding front and back views of the entrance orifice 410 and exit orifice 420 of FIG. 4*a*. Optimum dimensions of a non-circular aperture will be close to those of the exit orifice 420 or slightly smaller to the extent allowed by gas dynamics and/or "focusing" described above. In such a configuration, the orifice 420 is elongated parallel to the FAIMS cylindrical axis, with optimum length determined by the ion beam span inside the analytical gap. according to an embodiment of the invention.

In other aspects, MS or IMS interfaces featuring non-circular conductance limit apertures may have different designs. In particular, a non-circular aperture may be a part of either a curtain gas plate or a capillary that may or may not be heated. Unlike ions coming from ESI or AP-MALDI sources directly, ions emerging from FAIMS of any geometry are already desolvated (e.g., at API/FAIMS interface and further by RF heating in the analytical gap). Hence the optimum interface at FAIMS exit may be just a thin unheated aperture, as implemented, e.g., in the exemplary embodiment.

A non-circular ion beam formed by a non-circular aperture (in particular, a ribbon-shaped ion beam exiting an elongated aperture 200*a*-200*f* or 300*a*-300*c*) may, in principle, be transmitted to a following stage such as MS (or IMS) using any MS (or IMS) interface, and in some cases directly without any interface. When an interface is needed (e.g., for a further differential pumping capability), all designs known in the art (e.g., a skimmer-cone combination) in conjunction with preceding round apertures may be employed with non-circular apertures of the present invention. However, the best (near-100%) transmission of round ion beams formed by standard API inlets to downstream MS stages is provided by electrodynamic ion funnels, e.g., as described by Smith et al. (U.S. Pat. No. 6,107,628).

Figure 5:
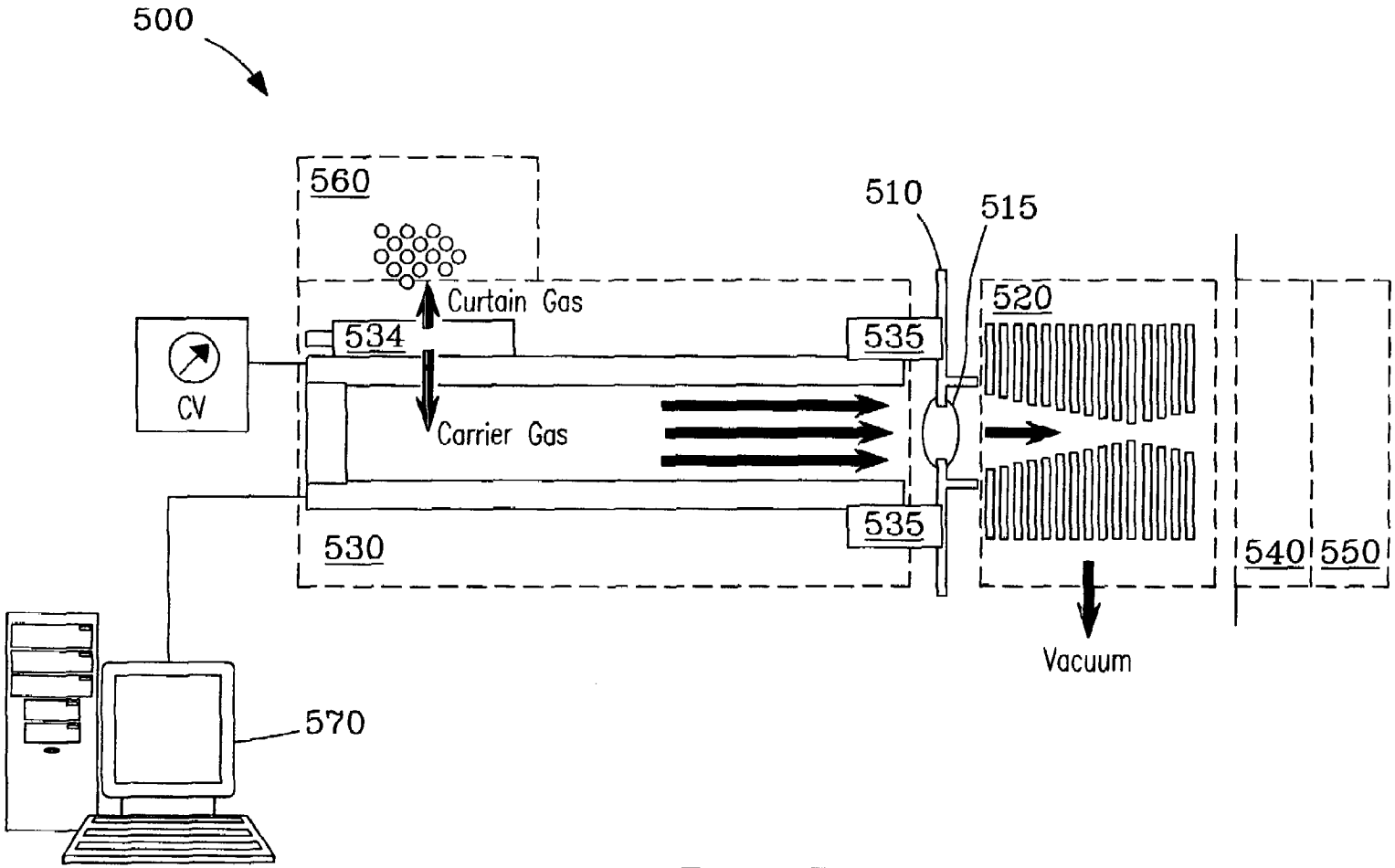
FIG. 5 illustrates an interface comprising a non-circular conductance limit aperture and an electrodynamic ion funnel, coupling p-FAIMS to an MS or IMS stage, according to an embodiment of the invention.

Non-circular ion beams formed by non-circular apertures of the present invention (and particularly ribbon-shape beams formed by elongated apertures such as those illustrated in FIGS. 2*a*-2*f* and FIGS. 3*a*-3*c*) may have maximum dimensions substantially exceeding those of beams formed by round apertures known in the art. Hence the capability of an ion funnel to collect and focus wide ion beams effectively is especially advantageous in conjunction with non-circular apertures of the present invention. In this configuration, the optimum diameter of funnel entrance should substantially exceed the maximum dimension of preceding non-circular aperture, e.g., as shown in FIG. 5 illustrating an instrument system 500, where a p-FAIMS analyzer 530 is coupled to a drift tube 540 and further to MS stage 550 by an interface comprising a plate 510 with the non-circular conductance limit aperture 515 of the invention and an electrodynamic ion funnel 520, according to an embodiment of the invention. In the figure, the FAIMS unit 530 is secured to interface 510 by an insulating holder 535, but is not limited thereto. The FAIMS stage 530 receives ions from an ion source 560, e.g., an ESI, but again is not limited thereto. The FAIMS unit 530 includes a curtain plate interface 534 described further in reference to FIG. 7 below. The instrument control, data acquisition and manipulation may be provided, e.g., by a computer 570, as will be understood by those of skill in the art. No limitations are intended. Currently demonstrated ion funnels 520 have entrance diameters up to 52 mm, which is more than sufficient for coupling of any planar or side-to-side FAIMS known in the art (the greatest gap span of p-FAIMS described to date is 20 mm). If needed, funnels with yet larger entrance orifices may be readily constructed by those skilled in the art following the disclosures of U.S. Pat. No. 6,107,628 and in publications including *Anal. Chem.* 1999, 71, 2957; *Anal. Chem.* 2000, 72, 2247; *J. Am. Soc. Mass Spectrom.* 2000, 11, 19.

Figure 6A:
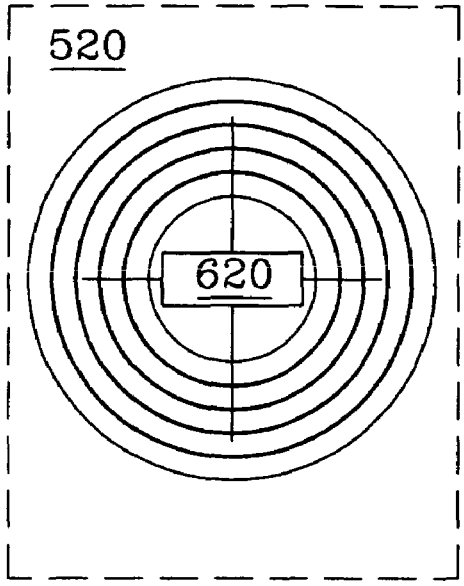
FIGS. 6*a*-6*b* illustrate front and side views of an ion funnel comprising a jet disrupter of non-circular (rectangular) geometry, according to an embodiment of the invention.
Figure 6B:
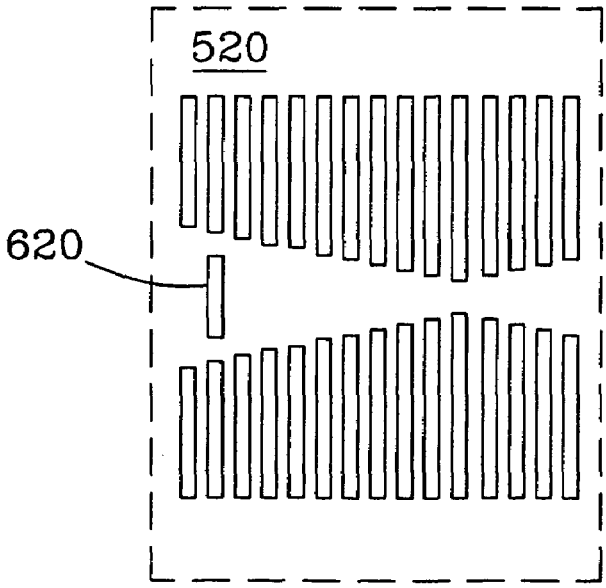

Performance of ion funnels at API interfaces using circular apertures is normally improved by a jet disrupter (or jet disturber), as taught, e.g., by Smith et al. (U.S. Pat. No. 6,583,408). A jet disrupter is a flat electrode installed on the funnel axis at some distance from the exit of the API inlet, with a (dc) voltage set separately from other funnel electrodes. In addition to suppressing chemical noise and thereby improving the signal/noise ratio as described above, the jet disrupter allows an effective modulation of the ion beam intensity by variation of dc voltage, e.g., as described with application to automatic gain control by Page et al. (*J. Am. Soc. Mass Spectrom.* 2005, 16, 244). That capability permits extending the dynamic range of MS measurements, which is crucial for many analytical applications. One would desire to preserve the full utility of a jet disrupter in conjunction with non-circular apertures of the present invention, which may require a jet disrupter of non-circular geometry matching or approximating that of a preceding non-circular aperture. In the instant case of an elongated aperture, the disrupter may optimally have an elongated geometry, e.g., as shown in FIG. 6*a*. FIGS. 6*a*-6*b* illustrate a front view and a side view, respectively, of an ion funnel 520 configured with a rectangular jet disrupter 620, according to an embodiment of the invention.

Ion sources (including but not limited to the ESI or AP-MALDI) preceding a non-circular aperture interface of the present invention may be further coupled to preceding stages for separation or analyses of substances in condensed phases. Those stages include, but are not limited to, e.g., liquid chromatography (LC), normal phase LC, reversed phase LC, strong-cation exchange LC, supercritical fluid chromatography, capillary electrophoresis, over-the-gel electrophoresis, capillary isoelectric focusing, isotachophoresis, gel separations in one or more dimensions, and combinations thereof.

An interface coupling two instrument stages may include two or more (identical or not identical) non-circular apertures of the present invention in sequence. In particular, this may be desirable when the interface involves multiple stages of differential pumping, with non-circular apertures providing conductance limits therebetween. This design may be useful for coupling stages with extremely different pressures and/or stages with limited pumping capacity.

Two or more interfaces with non-circular apertures of the present invention may be employed to sequentially couple more than two stages for generation, separation, or analyses of gas-phase ions, such as FAIMS, IMS-ADD, HODIMS, and IMS or MS, but are not limited thereto. For example, a planar or "side-to-side" FAIMS may be coupled to a planar IMS-ADD and then further to MS using two sequential interfaces with rectangular apertures.

The following examples are intended to promote a better understanding of the present invention. Example 1 details an embodiment of a p-FAIMS/MS interface employing a non-circular aperture of the invention. Example 2 demonstrates the improved instrumental sensitivity achieved for p-FAIMS/MS using a non-circular aperture of the invention, e.g., in conjunction with an ion funnel.

EXAMPLE 1

Demonstration of Non-Circular Aperture Interface

Figure 7:
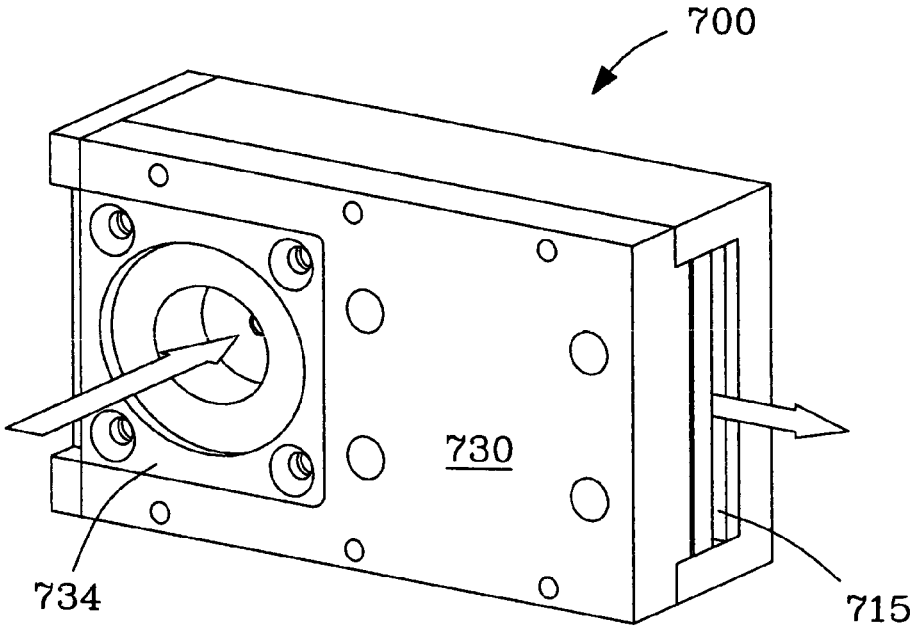
FIG. 7 illustrates an assembly of a custom-built planar FAIMS used to evaluate a non-circular aperture interface for p-FAIMS/MS coupling.

The invention has been demonstrated in a system 500 comprising three stages: a custom-built p-FAIMS 530 illustrated in FIG. 5 and FIG. 7, a drift tube 540, and a time-of-flight MS (Sciex Q-Star ToF MS) 550.

Experimental. A FAIMS stage 530 was coupled to a drift tube 540 and MS stage 550 as shown in FIG. 5, using a 25-mm "hourglass" ion funnel 520, e.g., as described by Smith et al. (U.S. Pat. No. 6,818,890, U.S. Pat. No. 6,967,325) incorporated herein in their entirety. Drift tube 540 was operated in the "continuous mode", i.e., with no mobility separation. Dimensions of the FAIMS 530 analytical gap were: width=2 mm, span=20 mm, length ~30 mm. Ion source 560 was an ESI source. Carrier gas was nitrogen ($N_2$) gas at ambient conditions, with the total flow of 2 L/min partitioned between the curtain gas desolvating ions at the ESI/FAIMS interface and carrier gas moving ions through FAIMS. FIG. 7 presents an end-on view 700 (with ~90 degree rotation from that presented in FIG. 5) of a FAIMS stage 730. Exit orifice 715 of stage 730 directly abuts a non-circular aperture 515 with a gap of ~0.5 mm left for electrical insulation and excess gas outflow. Flow of ions through curtain plate interface 734 and exit orifice 715 is indicated (by arrows). System 500 was operated in a standard regime, e.g., as described by Tang et al. (*Anal. Chem.* 2005, 77, 3330; *Anal. Chem.* 2005, 77, 6381).

EXAMPLE 2

Instrumental Sensitivity Using a Non-Circular Aperture Interface

Example 2 demonstrates the sensitivity improvement provided by the use of a non-circular aperture 515 described herein.

Figure 1:
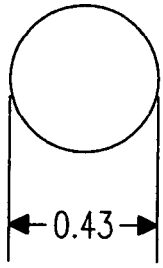
Fig. 1 (Prior Art)
FIG. 1 (Prior Art) illustrates a circular aperture used in MS and IMS interfaces.

Experimental. The improvement of analytical sensitivity provided by a non-circular aperture 515 was evaluated by benchmarking vs. an otherwise identical interface with a conventional round aperture, with all other instrument parameters kept constant. In the exemplary embodiment, described herein with reference to FIG. 5 and FIG. 3*a*, the non-circular aperture 515 is non-contiguous, consisting of 11 circular apertures 305 of 0.13 mm diameter, uniformly disposed along a 3.8 mm-long straight segment, for a total area of ~0.14 $mm^2$. The benchmark aperture (illustrated in FIG. 1) is a contiguous circle of 0.43 mm diameter with the same area of ~0.14 $mm^2$. Both apertures are manufactured out of 0.4 mm-thick metal sheet and are not heated.

Figure 8:
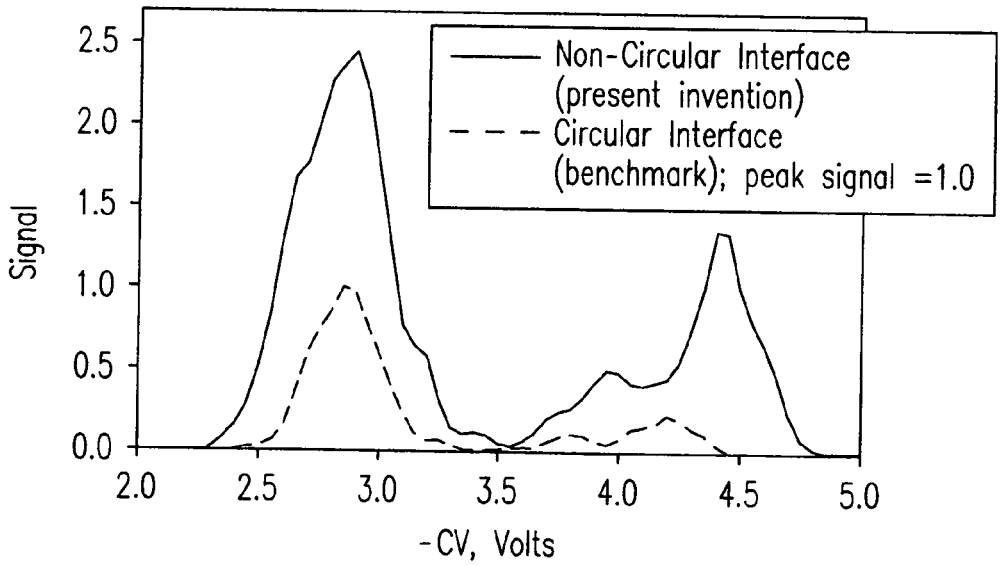
FIG. 8 demonstrates the enhanced sensitivity obtained when a p-FAIMS is coupled to an MS stage using an interface with a non-circular aperture (in conjunction with an ion funnel), according to an embodiment of the invention.

Results. Performance was evaluated for a protonated reserpine ion (m/z=609), as is customary in the MS art. The FAIMS DV was set at 3.8 kV and CV was scanned at 3 V/min. In operation, the pressure in the ion funnel chamber with the exemplary elongated and benchmark round apertures are equal (~4 Torr), confirming that the cross-sectional areas of apertures and gas flows through them are indeed close. The FAIMS CV spectra measured using the exemplary embodiment and benchmark are compared in FIG. 8. Using the non-circular aperture of the invention consistently improves the signal by a factor of at least 2.5 at any CV. The demonstrated improvement is limited because of very narrow elementary apertures in the exemplary embodiment, which (because of thermal ion diffusion) decreases the ion transmission disproportionately to the gas flow. This limitation will be relaxed by widening apertures, as allowed by the new high-pressure ion funnel interface.

CONCLUSIONS

While an exemplary embodiment of the present invention has been shown and described, it will be apparent to those skilled in the art that many changes and modifications may be made without departing from the invention in its true scope and broader aspects. The appended claims are therefore intended to cover all such changes and modifications as fall within the spirit and scope of the invention.

We claim:

1. An interface for transmission of ions between two operatively coupled instrument stages for analysis, characterization, separation, and/or generation of gas-phase ions with different gas pressures therein and a conductance limit therebetween, said interface comprising:

at least one aperture having a geometry that is other than circular, said at least one aperture providing an overlap greater than a circular aperture of equal area to an other than circular cross-section of an ion beam appearing from a stage preceding said interface and transmitted to a stage following said interface; and whereby the efficiency of ion transmission between said stages and the ion flux transmitted through said interface are substantially enhanced.

2. An interface of claim 1, wherein said at least one aperture has a contiguous geometry.

3. An interface of claim 1, wherein said at least one aperture has a non-contiguous geometry comprising at least two contiguous elementary apertures.

4. An interface of claim 1, wherein said geometry is an elongated geometry.

5. An interface of claim 4, wherein said geometry is selected from the group consisting of rectangular (slit), ellipsoid, ovoid, trapezoid, rhombic, triangular, or combinations thereof.

6. An interface of claim 4, wherein said geometry has a length in the range from about 0.5 mm to about 50 mm and width in the range from about 0.02 mm to about 4 mm.

7. An interface of claim 1, wherein said stage preceding said interface is selected from the group consisting of ion mobility spectrometry (IMS), field asymmetric waveform ion mobility spectrometry (FAIMS), longitudinal electric field-driven FAIMS, ion mobility spectrometry with alignment of dipole direction (IMS-ADD), higher-order differential ion mobility spectrometry (HODIMS), or combinations thereof.

8. An interface of claim 7, wherein the analytical gap geometry of said FAIMS, longitudinal electric field-driven FAIMS, IMS-ADD, or HODIMS stage is selected from the group consisting of parallel planar and non-parallel planar.

9. An interface of claim 7, wherein the analytical gap geometry of said FAIMS, longitudinal electric field-driven FAIMS, IMS-ADD, or HODIMS stage is selected from the group consisting of side-to-side coaxial cylindrical, side-to-side non-coaxial cylindrical, side-to-side segmented, or combinations thereof.

10. An interface of claim 9, wherein the exit orifice of said side-to-side FAIMS has a geometry elongated in the direction parallel to the cylindrical electrode axis or axes.

11. An interface of claim 10, wherein said elongated exit orifice geometry is selected from the group consisting of rectangular (slit), ellipsoid, ovoid, trapezoid, rhombic, triangular, or combinations thereof.

12. An interface of claim 1, wherein said stage preceding said interface is an ion source comprising multiple ion emitters arranged in a geometry that is other than circular.

13. An interface of claim 12, wherein said ion source is an electrospray ionization (ESI) or matrix-assisted laser desorption ionization (MALDI) source.

14. An interface of claim 12, further coupled on-line or off-line to at least one preceding method for separation or analysis of substances in condensed phases.

15. An interface of claim 14, wherein the at least one preceding method is selected from the group consisting of liquid chromatography (LC), normal phase LC, reversed phase LC, strong-cation exchange LC, supercritical fluid chromatography, capillary electrophoresis, over-the-gel electrophoresis, capillary isoelectric focusing, isotachophoresis, gel separations in one or more dimensions, and combinations thereof.

16. An interface of claim 1, wherein said stage following said interface comprises a member selected from the group consisting of IMS, selected-ion flow tube (SIFT) or other drift tube, FAIMS, longitudinal electric field-driven FAIMS, IMS-ADD, HODIMS, mass spectrometry (MS), tandem and multiple MS, gas chromatography (GC), photoelectron spectroscopy, spectroscopy, photodissociation spectroscopy, or combinations thereof.

17. An interface of claim 1, wherein said stage following said interface is coupled using an electrodynamic ion funnel providing efficient transmission of said ion beam that is other than circular appearing from said interface.

18. An interface of claim 17, wherein the gas pressure in said funnel is in the range from about 0.1 Torr to about 100 Torr.

19. An interface of claim 17, wherein the entrance orifice of said funnel has an internal diameter equal to or greater than the largest dimension of the other than circular aperture of said interface.

20. An interface of claim 17, wherein said funnel comprises a jet disrupter element with a non-circular geometry.

21. An interface of claim 20, wherein said jet disrupter has an elongated geometry selected from the group consisting of rectangular (slit), ellipsoid, ovoid, trapezoid, rhombic, triangular, or combinations thereof.

22. A method for transmission of ions between two operatively coupled instrument stages for analysis, characterization, separation, and/or generation of gas-phase ions with different gas pressures therein and a conductance limit therebetween, comprising the step of:

coupling two instrument stages using an interface with at least one aperture having a geometry that is other than circular, said at least one aperture providing an overlap greater than a circular aperture of equal area to an other than circular cross-section of an ion beam appearing from a stage preceding said interface and transmitted to a stage following said interface; and whereby the efficiency of ion transmission between said stages and the ion flux transmitted through said interface are substantially enhanced.

23. A method of claim 22, wherein said at least one aperture has a contiguous geometry.

24. A method of claim 22, wherein said at least one aperture has a non-contiguous geometry, consisting of at least two contiguous elementary apertures.

25. A method of claim 22, wherein said geometry is an elongated geometry.

26. A method of claim 25, wherein said geometry is selected from the group consisting of rectangular (slit), ellipsoid, ovoid, trapezoid, rhombic, triangular, or combinations thereof.

27. A method of claim 25, wherein said geometry has a length in the range from about 0.5 mm to about 50 mm and width in the range from about 0.02 mm to about 4 mm.

28. A method of claim 22, wherein said stage preceding said interface is selected from the group consisting of ion mobility spectrometry (IMS), field asymmetric waveform ion mobility spectrometry (FAIMS), longitudinal electric field-driven FAIMS, ion mobility spectrometry with alignment of dipole direction (IMS-ADD), higher-order differential ion mobility spectrometry (HODIMS), or combinations thereof.

29. A method of claim 28, wherein the analytical gap geometry of said FAIMS, longitudinal electric field-driven FAIMS, IMS-ADD, or HODIMS stage is selected from the group consisting of parallel planar and non-parallel planar.

30. A method of claim 28, wherein the analytical gap geometry of said FAIMS, longitudinal electric field-driven FAIMS, IMS-ADD, or HODIMS stage is selected from the group consisting of side-to-side coaxial cylindrical, side-to-side non-coaxial cylindrical, side-to-side segmented, or combinations thereof.

31. A method of claim 30, wherein the exit orifice of said side-to-side FAIMS has a geometry elongated in the direction parallel to the cylindrical electrode axis or axes.

32. An interface of claim 31, wherein said elongated exit orifice geometry is selected from the group consisting of rectangular (slit), ellipsoid, ovoid, trapezoid, rhombic, triangular, or combinations thereof.

33. A method of claim 22, wherein said stage preceding said interface is an ion source comprising multiple ion emitters arranged in a geometry that is other than circular.

34. A method of claim 33, wherein said ion source is an electrospray ionization (ESI) or a matrix-assisted laser desorption ionization (MALDI) source.

35. A method of claim 33, further coupled on-line or off-line to at least one preceding method for separation or analysis of substances in condensed phases.

36. A method of claim 35, wherein the at least one preceding method is selected from the group consisting of liquid chromatography (LC), normal phase LC, reversed phase LC, strong-cation exchange LC, supercritical fluid chromatography, capillary electrophoresis, over-the gel electrophoresis, capillary isoelectric focusing, isotachophoresis, gel separations in one or more dimensions, and combinations thereof.

37. A method of claim 22, wherein said stage following said interface comprises a member selected from the group consisting of IMS, selected-ion flow tube (SIFT) or other drift tube method, FAIMS, longitudinal electric field-driven FAIMS, IMS-ADD, HODIMS, mass spectrometry (MS), tandem and multiple MS, gas chromatography (GC), photoelectron spectroscopy, spectroscopy, photodissociation spectroscopy, or combinations thereof.

38. A method of claim 22, wherein said stage following said interface is coupled using an electrodynamic ion funnel providing efficient transmission of said ion beam that is other than circular appearing from said interface.

39. A method of claim 38, wherein the gas pressure in said funnel is in the range from about 0.1 Torr to about 100 Torr.

40. A method of claim 38, wherein the entrance orifice of said funnel has the internal diameter equal to or greater than the largest dimension of the other than circular aperture of said interface.

41. A method of claim 38, wherein said funnel comprises a jet disrupter element with a non-circular geometry.

42. A method of claim 41, wherein said jet disrupter has an elongated geometry selected from the group consisting of rectangular or slit, ellipsoid, ovoid, trapezoid, rhombic, triangular, or combinations thereof.

43. A method of claim 22, further comprising sequential application of the same method to successive interfaces coupling several successive instrument stages.

* * * * *

UNITED STATES PATENT AND TRADEMARK OFFICE

CERTIFICATE OF CORRECTION

PATENT NO. : 7,339,166 B2
APPLICATION NO. : 11/361264
DATED : March 4, 2008
INVENTOR(S) : K Tang, A A Shvartsburg and R D Smith It is certified that error appears in the above-identified patent and that said Letters Patent is hereby corrected as shown below:

Column 1, lines 6 through 9 of the issued patent should read as follows:

The invention was made with Government support under grant number RR018522 from the U.S. National Institutes of Health and contract DE-AC05-76RL01830 awarded by the US Department of Energy. The government has certain rights in the invention.

Signed and Sealed this
Eleventh Day of September, 2012

David J. Kappos

David J. Kappos
*Director of the United States Patent and Trademark Office*